US006579151B2

(12) United States Patent
Tseng et al.

(10) Patent No.: US 6,579,151 B2
(45) Date of Patent: Jun. 17, 2003

(54) RETAINING RING WITH ACTIVE EDGE-PROFILE CONTROL BY PIEZOELECTRIC ACTUATOR/SENSORS

(75) Inventors: Tung-Ching Tseng, Shindian (TW); Sheng Yung Liu, Pingien (TW)

(73) Assignee: Taiwan Semiconductor Manufacturing Co., Ltd, Hsin Chu (TW)

( * ) Notice: Subject to any disclaimer, the term of this patent is extended or adjusted under 35 U.S.C. 154(b) by 0 days.

(21) Appl. No.: 09/920,876

(22) Filed: Aug. 2, 2001

(65) Prior Publication Data

US 2003/0027498 A1 Feb. 6, 2003

(51) Int. Cl.[7] ..... B24B 49/00

(52) U.S. Cl. ..... 451/11; 451/9; 451/41; 451/287; 451/288; 451/398

(58) Field of Search ..... 451/9, 10, 11, 451/8, 41, 285, 287, 288, 397, 398

(56) References Cited

U.S. PATENT DOCUMENTS 5,997,384 A * 12/1999 Blalock ..... 451/41
6,143,123 A * 11/2000 Robinson et al. ..... 156/344
6,280,289 B1 * 8/2001 Wiswesser et al. ..... 451/6
6,325,696 B1 * 12/2001 Boggs et al. ..... 451/5

* cited by examiner

*Primary Examiner*—Eileen P. Morgan
(74) *Attorney, Agent, or Firm*—Randy W. Tung

(57) ABSTRACT

A polishing head for holding a wafer during a polishing process without the edge-effect or the edge peeling defect and a method for improving edge profile on a wafer during a polishing process are described. The polishing head is constructed by a carrier head, a retaining ring, and at least three piezoelectric actuator/sensors mounted in-between a recessed peripheral edge portion of the carrier head and a top surface of the retaining ring.

14 Claims, 3 Drawing Sheets

RETAINING RING WITH ACTIVE EDGE-PROFILE CONTROL BY PIEZOELECTRIC ACTUATOR/SENSORS

FIELD OF THE INVENTION

The present invention generally relates to a retaining ring used in a polishing head for a polishing process and a method for using and more particularly, relates to a retaining ring that has active edge profile control by using piezoelectric actuator/sensors and a method for using the retaining ring.

BACKGROUND OF THE INVENTION

Apparatus for polishing thin, flat semiconductor wafers is well-known in the art. Such apparatus normally includes a polishing head which carries a membrane for engaging and forcing a semiconductor wafer against a wetted polishing surface, such as a polishing pad. Either the pad, or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired. The polishing head is typically mounted on an elongated pivoting carrier arm, which can move the pressure head between several operative positions. In one operative position, the carrier arm positions a wafer mounted on the pressure head in contact with the polishing pad. In order to remove the wafer from contact with the polishing surface, the carrier arm is first pivoted upwardly to lift the pressure head and wafer from the polishing surface. The carrier arm is then pivoted laterally to move the pressure head and wafer carried by the pressure head to an auxiliary wafer processing station. The auxiliary processing station may include, for example, a station for cleaning the wafer and/or polishing head; a wafer unload station; or, a wafer load station.

More recently, chemical-mechanical polishing (CMP) apparatus has been employed in combination with a pneumatically actuated polishing head. CMP apparatus is used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A schematic of a typical CMP apparatus is shown in FIGS. 1A and 1B. The apparatus 10 for chemical mechanical polishing consists of a rotating wafer holder 14 that holds the wafer 10, the appropriate slurry 24, and a polishing pad 12 which is normally mounted to a rotating table 26 by adhesive means. The polishing pad 12 is applied to the wafer surface 22 at a specific pressure. The chemical mechanical polishing method can be used to provide a planar surface on dielectric layers, on deep and shallow trenches that are filled with polysilicon or oxide, and on various metal films. CMP polishing results from a combination of chemical and mechanical effects. A possible mechanism for the CMP process involves the formation of a chemically altered layer at the surface of the material being polished. The layer is mechanically removed from the underlying bulk material. An altered layer is then regrown on the surface while the process is repeated again. For instance, in metal polishing, a metal oxide may be formed and removed repeatedly.

A polishing pad is typically constructed in two layers overlying a platen with the resilient layer as the outer layer of the pad. The layers are typically made of polyurethane and may include a filler for controlling the dimensional stability of the layers. The polishing pad is usually several times the diameter of a wafer and the wafer is kept off-center on the pad to prevent polishing a non-planar surface onto the wafer. The wafer is also rotated to prevent polishing a taper into the wafer. Although the axis of rotation of the wafer and the axis of rotation of the pad are not collinear, the axes must be parallel. It is known in the art that uniformity in wafer polishing is a function of pressure, velocity and the concentration of chemicals. Edge exclusion is caused, in part, by a non-uniform pressure applied on a wafer. The problem is reduced somewhat through the use of a retaining ring which engages the polishing pad, as shown in the Shendon et al patent.

Referring now to FIG. 1C, wherein an improved CMP head 20, sometimes referred to as a Titan® head which differs from conventional CMP heads in two major respects is shown. First, the Titan® head employs a compliant wafer carrier and second, it utilizes a mechanical linkage (not shown) to constrain tilting of the head, thereby maintaining planarity relative to a polishing pad 12, which in turn allows the head to achieve more uniform flatness of the wafer during polishing. The wafer 10 has one entire face thereof engaged by a flexible membrane 16, which biases the opposite face of the wafer 10 into face-to-face engagement with the polishing pad 12. The polishing head and/or pad 12 are moved relative to each other, in a motion to effect polishing of the wafer 10. The polishing head includes an outer retaining ring 14 surrounding the membrane 16, which also engages the polishing pad 12 and functions to hold the head in a steady, desired position during the polishing process. As shown in FIG. 1C, both the retaining ring 14 and the membrane 16 are urged downwardly toward the polishing pad 12 by a linear force indicated by the numeral 18 which is effected through a pneumatic system.

More detailed views of the Titan® head are shown in FIGS. 2A and 2B. FIG. 2A shows that in a Titan® head, two separate pressure chambers of a carrier chamber 30 and a membrane chamber 32 are used during a polish process. A carrier pressure 34 exerts on the retaining ring 14, while a membrane pressure 18 translates into wafer backside pressure. The retaining pressure is a function of both the membrane pressure and the carrier pressure, for instance, $P_{RR}=2.039\ P_{CAR}-1.908\ P_{MEM}$.

The operation of the Titan® head 20 can be shown in FIG. 2B. The Titan® head 20 picks up a wafer 10 by forming a suction cup with its membrane 16. A pressure is applied to the innertube 28 to force the membrane 16 downwardly onto the wafer 10 to ensure a good seal with the suction cup. A vacuum is thus applied to the membrane 16 to lift the wafer 10. The innertube 28 has little effect on the process because it is pressurized to the same pressure as the membrane chamber 32. During a polishing process, a pressure of approximately 5.2 psi is applied on the retaining ring which is higher than a pressure of approximately 4.5 psi that is applied on the membrane, i.e., on the wafer. The higher pressure applied on the retaining ring ensures that the wafer 10 is always retained in the retaining ring 14. However, after repeated usage, the bottom surface 36 of the retaining ring may be worn out and the wafer 10 may slide out during a polishing process. When such defective condition occurs, the wafer may be severely damaged or even broken.

While the Titan® head described above is equipped with means for applying a pressure on the retaining ring directly, i.e. the carrier pressure 34, the same pressure is applied across the entire retaining ring. In other words, the pressure applied on the retaining ring cannot be customized at different locations to compensate for uneven polishing on a polishing pad. Moreover, in certain other carrier head for wafers, such as those utilized in a linear chemical mechanical polishing apparatus, there is no provision for applying a pressure on the retaining ring at all.

As described above, production CMP tools are either with (i.e. Applied Materials™ tools) or without (i.e. Lam Research® tools) active retaining rings on the carrier head. Wafers polished on CMP tools without active retaining rings may suffer from edge peeling due to high stresses incurred at wafer edge caused by pad dynamics. CMP tools with active retaining rings, such as those of Titan® head, usually employ gas pressure as a control input to control the retaining ring pressure. Due to machining tolerance and the dynamic behavior of the process, such a single-input-single-output system may not be able to provide a uniform ring pressure across the ring throughout a CMP process.

Commercial CMP tools usually use a carrier head to carry or hold wafers during polishing and wafer transfer. A carrier head provides a flat surface to apply a desired pressure on the backside of a wafer to press the front side of the wafer against the polishing pad during the polishing process. The frictional force between the wafer and the polishing pad can slide the wafer away from the carrier head if the wafer is not constrained. A retaining ring therefore provides such a mechanism to constrain the sliding movement of a wafer during the polishing process.

A polishing pad is normally a sheet of porous material which provides pathways for slurry to reach the wafer surface. The pad is not rigid, and therefore, can be compressed by an external force. During the polishing process, the pad has a free thickness where it is away from the wafer, and a compressed (or smaller) thickness underneath the wafer, with a transition region across the wafer edge. As a result, there is a transition in stress at the wafer edge. An "edge-effect" caused by such a stress transition can lead to process failures such as edge peeling. It is therefore desirable to use the retaining ring to extend the effective wafer-edge outwardly in the radial direction such that the transition region occurs at the retaining ring edge instead of at the wafer edge. However, if the retaining ring is in contact with the polishing pad, it will be consumed as the wafer is being polished. A mechanism is therefore required to actively control the retaining ring to compensate for the consumption of the ring.

It is therefore an object of the present invention to provide a polishing head for holding a wafer therein during a polishing process that does not have the drawbacks or shortcomings of the conventional polishing heads.

It is another object of the present invention to provide a polishing head for holding a wafer therein during a polishing process that does not produce an edge-effect on the wafer after the polishing is completed.

It is a further object of the present invention to provide a polishing head for holding a wafer therein during a polishing process which does not create defects such as edge peeling on the wafer after the polishing process is completed.

It is another further object of the present invention to provide a polishing head for holding a wafer therein during a polishing process that does not have the edge-effect on the wafer for use either in a rotary or a linear CMP process.

It is still another object of the present invention to provide a polishing head for holding a wafer therein during a polishing process that does not have an edge-effect by using piezoelectric actuator/sensors installed between a carrier head and a retaining ring.

It is yet another object of the present invention to provide a polishing head for holding a wafer therein during a polishing process that does not have the edge-effect on the wafer by using at least three piezoelectric actuator/sensors mounted in-between a carrier head and a retaining ring.

It is still another further object of the present invention to provide a method for improving edge profile on a wafer during a polishing process such that a defect of edge peeling can be avoided.

It is yet another further object of the present invention to provide a method for improving edge profile on a wafer during a polishing process without the edge-effect by mounting at least three piezoelectric actuator/sensors in-between a carrier head and a retaining ring.

SUMMARY OF THE INVENTION

In accordance with the present invention, a polishing head for holding a wafer therein during a polishing process that does not produce an edge-effect and a method for using the polishing head are disclosed.

In a preferred embodiment, a polishing head for holding a wafer therein during a polishing process is provided which includes a carrier head that has a recessed peripheral edge portion adapted for engaging top surfaces of at least three piezoelectric actuator/sensors spaced-apart equally along the peripheral edge portion, and a non-recessed center portion that has a bottom surface for intimately engaging a wafer; a retaining ring surrounding the wafer that has a bottom surface in the same horizontal plane of an active surface of the wafer, the retaining ring has a top surface adapted for engaging bottom surfaces of the at least three piezoelectric actuator/sensors; and at least three piezoelectric actuator/sensors mounted in-between the recessed peripheral edge portion of the carrier head and the top surface of the retaining ring.

In the polishing head for holding a wafer therein during a polishing process, the at least three piezoelectric actuator/sensors are each mounted by mounting screws engaging the recessed peripheral edge portion of the carrier head and the top surface of the retaining ring. The at least three piezoelectric actuator/sensors are four piezoelectric actuator/sensors that are mounted equally spaced along the peripheral edge portion. Each of the at least three piezoelectric actuator/sensors exerts an expansion force against the recessed peripheral edge portion of the carrier head and the top surface of the retaining ring when a current is received by the actuator/sensor. The polishing head may further include means for generating air pressure on top of the carrier head for pushing the carrier head downwardly for engaging the wafer to a polishing pad. The carrier head may be used in a rotary-type chemical mechanical polishing apparatus or a linear chemical mechanical polishing apparatus. The polishing head may further include a process controller for receiving force signals on the at least three piezoelectric actuator/sensors, comparing the force signals to pre-stored data, and delivering an electrical current to the at least three piezoelectric actuator/sensors to increase/decrease forces exerted on the retaining ring.

The present invention is further directed to a method for improving edge profile on a wafer during a polishing process which can be carried out by the operating steps of first providing a carrier head that has a recessed peripheral edge portion adapted for engaging top surfaces of at least three piezoelectric actuator/sensors spaced-apart equally along the peripheral edge portion, and a non-recessed center portion that has a bottom surface for intimately engaging a wafer; mounting a retaining ring to surround the wafer, the retaining ring has a bottom surface in the same horizontal plane of an active surface of the wafer, the retaining ring has a top surface adapted for engaging bottom surfaces of the at least three piezoelectric actuator/sensors; mounting at least three piezoelectric actuator/sensors in-between the recessed peripheral edge portion of the carrier head and the top surface of the retaining ring; and flowing a current to and subsequently causing the at least three piezoelectric actuator/sensors to exert a downward force on the retaining ring to improve an edge profile of polishing on the wafer.

The method for improving edge profile on a wafer during a polishing process may further include the step of sensing a force on the retaining ring by the at least three piezoelectric actuator/sensors. The method may further include the step of sensing a force on the retaining ring by the at least three piezoelectric actuator/sensors and sending a signal to a process controller for comparing to a pre-stored datum. The method may further include the steps of sensing a force on the retaining ring by the at least three piezoelectric actuator/sensors, sending a signal to a process controller for comparing to a pre-stored datum, and then flowing a current through the at least three piezoelectric actuator/sensors to increase the force. The method may further include the step of mounting the at least three piezoelectric actuator/sensors by mechanical means, or by screws to the recessed peripheral edge portion of the carrier head and the top surface of the retaining ring. The method may further include the step of mounting four piezoelectric actuator/sensors equally spaced from each other in-between the recessed peripheral edge portion of the carrier head and the top surface of the retaining ring. The method may further include the step of pushing the carrier head downwardly by air pressure to engage the wafer to a polishing pad, or to a polishing pad in a rotary chemical mechanical polishing apparatus, or to a polishing pad in a linear chemical mechanical polishing apparatus.

BRIEF DESCRIPTION OF THE DRAWINGS

These and other objects, features and advantages of the present invention will become apparent from the following detailed description and the appended drawings in which:

FIG. 5 is a partial, enlarged, cross-sectional view of the present invention retaining ring, carrier head, and a piezoelectric actuator/sensor mounted therein-between.

DETAILED DESCRIPTION OF THE PREFERRED EMBODIMENT

Figure 1A:
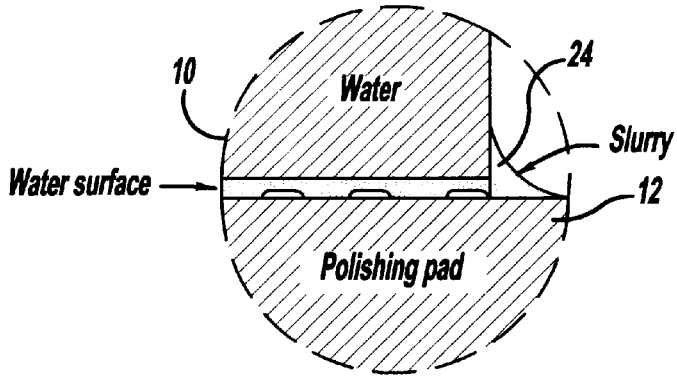
Figure - 1a PRIOR ART
FIG. 1A is a side view of a conventional chemical mechanical polishing apparatus.
Figure 1B:
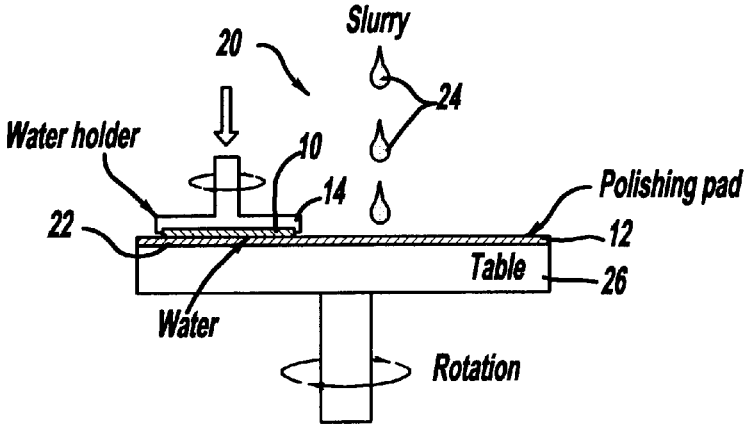
Figure - 1b PRIOR ART
FIG. 1B is a partial, enlarged, cross-sectional view of a wafer surface situated on a polishing pad.
Figure 1C:
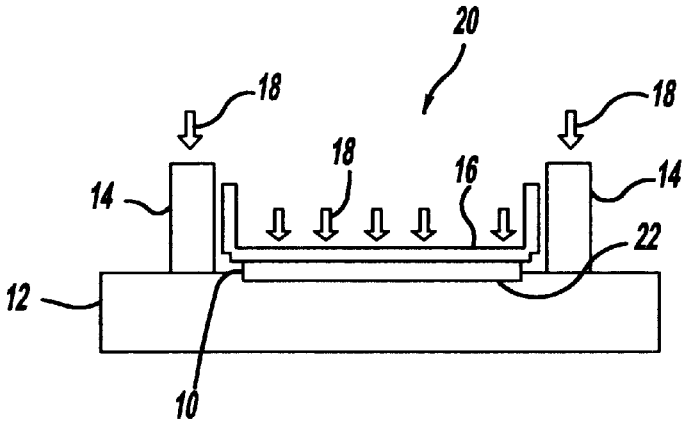
Figure - 1c PRIOR ART
FIG. 1C is a cross-sectional view of an improved polishing head, or the Titan® polishing head.
Figure 2A:
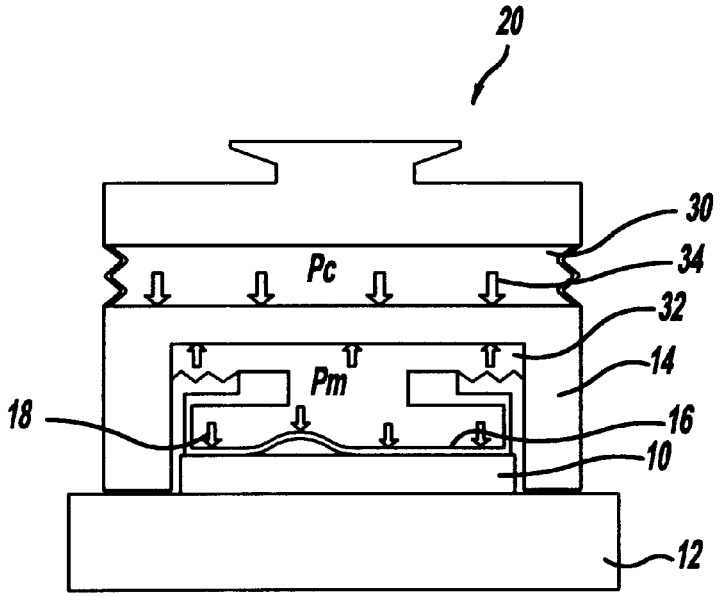
Figure - 2a PRIOR ART
FIG. 2A is a cross-sectional view of a Titan® head illustrating two pressure chambers of a carrier chamber and a membrane chamber.
Figure 2B:
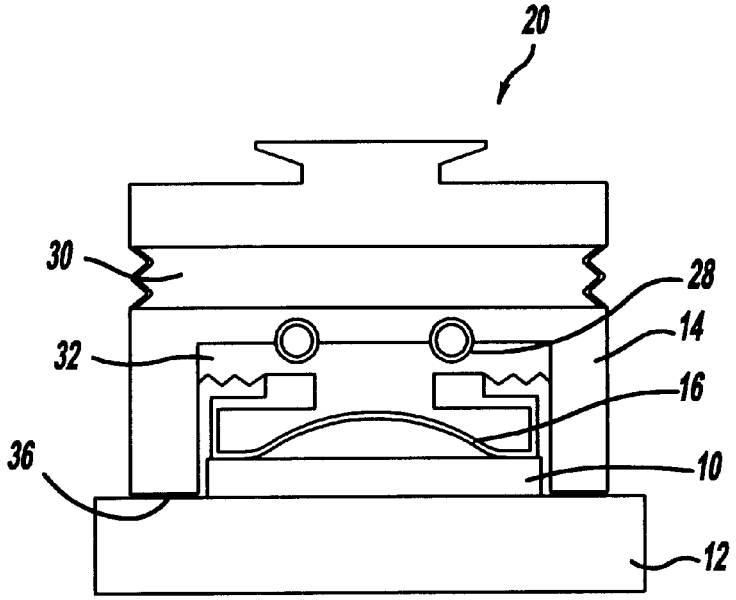
Figure - 2b PRIOR ART
FIG. 2B is a cross-sectional view of a Titan® head illustrating three fluid chambers of an inner tube chamber, a membrane chamber and a retaining ring chamber.

The present invention discloses a polishing head for holding a wafer therein during a polishing process which includes a carrier head, a retaining ring and at least three piezoelectric actuator/sensors. The carrier head is equipped with a recessed peripheral edge portion for engaging the at least three piezoelectric actuator/sensors which are spaced-apart equally along the edge portion. A non-recessed center portion of the carrier head has a bottom surface for intimately engaging a wafer. The retaining ring is mounted surrounding the wafer and has a bottom surface in the same horizontal plane of an active surface of the wafer. The retaining ring further has a top surface for engaging the bottom surfaces of the at least three piezoelectric actuator/sensors. The at least three piezoelectric actuator/sensors are mounted in-between the recessed peripheral edge portion of the carrier head and the top surface of the retaining ring.

The invention further provides a method for improving the edge profile on a wafer after a polishing process which can be carried out by providing a carrier head and a retaining ring, mounting at least three piezoelectric actuator/sensors in-between a recessed peripheral edge portion on the carrier head and a top surface of the retaining ring; and then flowing a current to and subsequently causing the at least three piezoelectric actuator/sensors to exert a downward force on the retaining ring to improve an edge profile of polishing on the wafer.

In the present invention novel apparatus, the piezoelectric material is used as an actuator as well as a sensor for position/force control. Due to the lubrication/viscous force, the pressure underneath the wafer and the retaining ring is not uniform during polishing. As the carrier head rotates, the retaining ring is exposed to a periodic dynamic load, instead of a constant static load. With the present invention multiple piezoelectric actuator/sensors implemented to control the retaining ring, it is possible to better control the retaining ring pressure, or wafer reveal under such a dynamic condition.

The invention utilizes piezoelectric actuator/sensors to control the retaining ring pressure or wafer reveal, and thus better control the retaining ring pressure distribution with a multi-input-multi-output (MIMO) system. Various processing difficulties are solved by the present invention novel apparatus which includes wafer edge peeling, non-uniform retaining ring pressure, and compensation for in-coming wafer or retaining ring variations. The present invention piezoelectric actuator/sensors are capable of not only sensing a pressure, but also applying a pressure onto the retaining ring.

The present invention utilizes at least three, and preferably four or more, piezoelectric actuator/sensors in-between a carrier head and a retaining ring to extend an effective wafer-edge outwardly such that a stress transition region occurs at the retaining ring edge instead of at the wafer edge. A mechanism is also provided to actively control the retaining ring to compensate for the consumption of the retaining ring surface due to friction. The mechanism involves a process controller for receiving a force signal from the piezoelectric sensor, comparing to pre-stored data in the process controller, and then sending out a force signal to the piezoelectric actuator for exerting a force on the retaining ring and thus actively controlling the ring to compensate for the consumption of the ring surface.

A piezoelectric actuator is a device that produces a displacement (or movement) when a voltage is applied. The actuators can be used for many different functions including canceling vibration, tool adjustment and control, micropumps, mirror positioning, etc. When a voltage is applied to the assembly, it produces small displacements with a large force capability. The principle of the piezoelectric element is that when a piezoelectric element is stressed (electrically by a voltage), its dimensions change. Conversely, when the piezoelectric element is stressed mechanically by a force, it generates an electric charge. The element is therefore both an actuator and a sensor. The relationship between applied forces and the resultant responses depends on the piezoelectric properties of the element, the size and shape of the piece, and the direction of the electrical and mechanical excitation.

Figure 3:
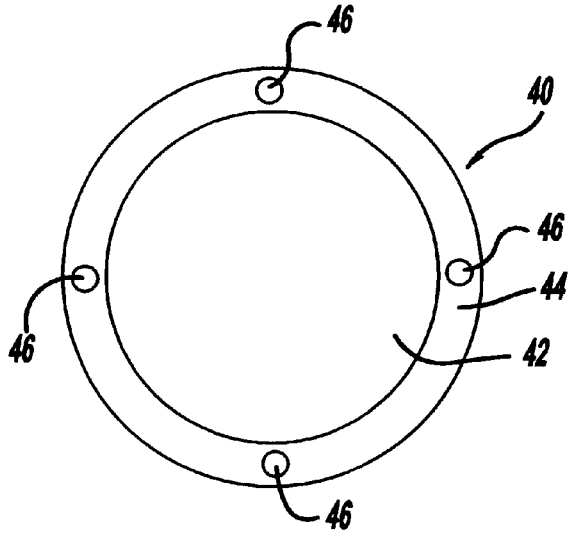
FIG. 3 is a bottom view of a present invention retaining ring equipped with four piezoelectric actuator/sensors and a carrier head.
Figure 4:
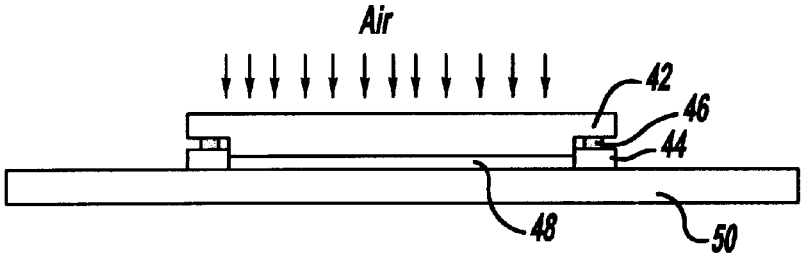
FIG. 4 is a cross-sectional view of the present invention retaining ring/carrier head equipped with four piezoelectric actuator/sensors engaging a polishing pad.

Referring now to FIG. 3, wherein a bottom view of a present invention carrier head/retaining ring assembly 40 is shown. The carrier head/retaining ring assembly 40 consists of a carrier head 42, a retaining ring 44 and four piezoelectric actuator/sensors 46. The mounting position of the piezoelectric actuator/sensors 46 in-between the carrier head 42 and the retaining ring 44 is shown in FIG. 4, in a cross-sectional view. Also shown in FIG. 4 is a polishing head 50 that the wafer 48 is pressed against by air pressure exerted on top of the carrier head 42.

Figure 5:
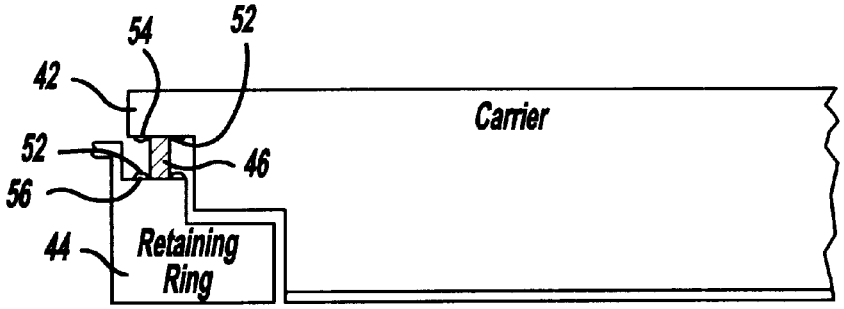

A detailed view of the mounting of piezoelectric actuator/sensors 46 in-between a carrier head 42 and the retaining ring 44 is shown in FIG. 5, in a partial, cross-sectional view. As shown in FIG. 5, the piezoelectric actuator/sensors 46 is mounted to the carrier head 42 by screws 52 through a top flange 54 of the actuator/sensors 46. Similarly, the piezoelectric actuator/sensor 46 is mounted to the retaining ring 44 through a bottom flange 56 by screws 52. It should be noted that, any other suitable mounting method may be utilized, such as one that only the top flange is fixed to the carrier head by screws 52 with the bottom of the actuator/sensor 46 positioned in a recessed seat (not shown) formed in the top surface of the retaining ring.

A process controller (not shown) receives a force signal from the actuator/sensor 46 comparing the force signal to pre-stored data in the process controller, and then sends out a force signal to the actuator 46 in the form of an electrical current to further expand the actuator 46 and thus, applying a larger force (downwardly) onto the retaining ring 44 against the polishing pad 50. Such downward force thus is capable of extending the effective wafer-edge outwardly in a radial direction such that a stress transition region occurs at the retaining ring edge instead of at the wafer-edge. The present invention novel apparatus, in combination with the process controller, can be used to actively control the retaining ring by the downward force applied thereto to compensate for the consumption of the ring surface during frictional engagement with the polishing pad.

The present invention polishing head for holding a wafer during a polishing process without the edge-effect, or the edge peeling defect and a method for using the polishing head have therefore been amply described in the above description and in the appended drawings of FIGS. 3, 4 and 5.

While the present invention has been described in an illustrative manner, it should be understood that the terminology used is intended to be in a nature of words of description rather than of limitation.

Furthermore, while the present invention has been described in terms of a preferred embodiment, it is to be appreciated that those skilled in the art will readily apply these teachings to other possible variations of the inventions.

The embodiment of the invention in which an exclusive property or privilege is claimed are defined as follows.

What is claimed is:

1. A polishing head for holding a wafer therein during a polishing process comprising:

a carrier head having a recessed peripheral edge portion adapted for engaging top surfaces of at least three piezoelectric actuator/sensors spaced-apart equally along said peripheral edge portion, and a non-recessed center portion having a bottom surface for intimately engaging a wafer;

a retaining ring surrounding said wafer having a bottom surface in the same horizontal plane of an active surface of said wafer, said retaining ring having a top surface adapted for engaging bottom surfaces of said at least three piezoelectric actuator/sensors;

at least three piezoelectric actuator/sensors mounted in-between said recessed peripheral edge portion of said carrier head and said top surface of said retaining ring; and a process controller for receiving force signals from said at least three piezoelectric actuator/sensors, comparing the force signals to pre-stored data, and delivering an electrical current to said at least three piezoelectric actuator/sensors to increase/decrease forces exerted on said retaining ring.

2. A polishing head for holding a wafer therein during a polishing process according to claim 1, wherein said at least three piezoelectric actuator/sensors are each mounted by mounting screws engaging said recessed peripheral edge portion of the carrier head and said top surface of the retaining ring.

3. A polishing head for holding a wafer therein during a polishing process according to claim 1, wherein said at least three piezoelectric actuator/sensors are four piezoelectric actuator/sensors that are mounted equally spaced along said peripheral edge portion.

4. A polishing head for holding a wafer therein during a polishing process according to claim 1, wherein each of said at least three piezoelectric actuator/sensors exerts an expansion force against said recessed peripheral edge portion of the carrier head and said top surface of the retaining ring when a current is received by said actuator/sensor.

5. A polishing head for holding a wafer therein during a polishing process according to claim 1 further comprising means for generating air pressure on top of said carrier head for pushing said carrier head downwardly for engaging said wafer to a polishing pad.

6. A polishing head for holding a wafer therein during a polishing process according to claim 1, wherein said carrier head is used in a rotary-type chemical mechanical polishing apparatus.

7. A polishing head for holding a wafer therein during a polishing process according to claim 1, wherein said carrier head is used in a linear chemical mechanical polishing apparatus.

8. A method for improving edge profile on a wafer during a polishing process comprising the steps of:

providing a carrier head having a recessed peripheral edge portion adapted for engaging top surfaces of at least three piezoelectric actuator/sensors spaced-apart equally along said peripheral edge portion, and a non-recessed center portion having a bottom surface for intimately engaging a wafer;

mounting a retaining ring to surround said wafer, said retaining ring having a bottom surface in the same horizontal plane of an active surface of said wafer, said retaining ring having a top surface adapted for engaging bottom surfaces of said at least three piezoelectric actuator/sensors;

mounting at least three piezoelectric actuator/sensors in-between said recessed peripheral edge portion of said carrier head and said top surface of said retaining ring; and sensing a force on said retaining ring by said at least three piezoelectric actuator/sensors, sending a signal to a process controller for comparing said force to a pre-stored datum, and flowing a current through said at least three piezoelectric actuator/sensors to increase said force.

9. A method for improving edge profile on a wafer during a polishing process according to claim 8 further comprising the step of mounting said at least three piezoelectric actuator/sensors by mechanical means.

10. A method for improving edge profile on a wafer during a polishing process according to claim 8 further comprising the step of mounting said at least three piezoelectric actuator/sensors by screws to said recessed peripheral edge portion of said carrier head and said top surface of said retaining ring.

11. A method for improving edge profile on a wafer during a polishing process according to claim 8 further comprising the step of mounting four piezoelectric actuator/sensors equally spaced from each other in-between said recessed peripheral edge portion of said carrier head and said top surface of the retaining ring.

12. A method for improving edge profile on a wafer during a polishing process according to claim 8 further comprising the step of pushing said carrier head downwardly by air pressure to engage said wafer to a polishing pad.

13. A method for improving edge profile on a wafer during a polishing process according to claim 8 further comprising the step of pushing said carrier head downwardly by air pressure to engage said wafer to a polishing pad in a rotary chemical mechanical polishing apparatus.

14. A method for improving edge profile on a wafer during a polishing process according to claim 8 further comprising the step of pushing said carrier head downwardly by air pressure to engage said wafer to a polishing pad in a linear chemical mechanical polishing apparatus.

* * * * *